US012196479B2

(12) United States Patent
Li et al.

(10) Patent No.: US 12,196,479 B2
(45) Date of Patent: Jan. 14, 2025

(54) REFRIGERATOR WITH IMPROVED EVAPORATOR INSTALLATION STRUCTURE

(71) Applicants: QINGDAO HAIER REFRIGERATOR CO., LTD., Shandong (CN); HAIER SMART HOME CO., LTD., Shandong (CN)

(72) Inventors: Wei Li, Qingdao (CN); Dongqiang Cao, Qingdao (CN); Hui Liu, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 390 days.

(21) Appl. No.: 17/642,315

(22) PCT Filed: Sep. 9, 2020

(86) PCT No.: PCT/CN2020/114255
§ 371 (c)(1),
(2) Date: Mar. 11, 2022

(87) PCT Pub. No.: WO2021/047548
PCT Pub. Date: Mar. 18, 2021

(65) Prior Publication Data

US 2022/0341654 A1 Oct. 27, 2022

(30) Foreign Application Priority Data

Sep. 12, 2019 (CN) ..... 201910866595.1

(51) Int. Cl.
*F25D 23/00* (2006.01)
*F25D 17/06* (2006.01)
*F25D 23/06* (2006.01)

(52) U.S. Cl.
CPC ..... *F25D 23/006* (2013.01); *F25D 17/065* (2013.01); *F25D 23/066* (2013.01); *F25D 23/067* (2013.01)

(58) Field of Classification Search
CPC ..... F25D 17/067; F25D 21/14; F25D 23/006
See application file for complete search history.

(56) References Cited

U.S. PATENT DOCUMENTS 3,027,735 A 4/1962 Preotle et al.
3,475,920 A * 11/1969 Jacobs ..... F25D 23/068 62/385

FOREIGN PATENT DOCUMENTS

CN 107664377 A 2/2018
CN 208475771 U 2/2019
(Continued)

OTHER PUBLICATIONS

1st Examination Report for Australia Patent Application No. 2020346171 dated Jan. 30, 2023 (3 pages).
(Continued)

*Primary Examiner* — Eric S Ruppert
(74) *Attorney, Agent, or Firm* — ALSTON & BIRD LLP

(57) ABSTRACT

A refrigerator, comprising: a refrigerator body, comprising a storage liner at a bottommost position; a top cover, arranged to divide the storage liner into a storage space at the upper part and a cooling space at the lower part; and an evaporator, arranged in the cooling space and configured to cool airflow entering the cooling space to form cooling airflow; wherein the evaporator is placed on a bottom wall of the storage liner, and the bottom wall is provided with a limit structure at the front part and rear part of the evaporator respectively, to realize front and rear limits of the evaporator.

11 Claims, 9 Drawing Sheets

(56) References Cited

FOREIGN PATENT DOCUMENTS

| | | | | |
|---|---|---|---|---|
| CN | 208817806 | U | | 5/2019 |
| CN | 208817837 | U | | 5/2019 |
| CN | 110579071 | A | | 12/2019 |
| EP | 3309482 | A1 | | 4/2018 |
| GB | 815460 | A | | 6/1959 |
| JP | 2006308139 | A | * | 11/2006 |
| JP | 2006308140 | A | | 11/2006 |
| JP | 4555142 | B2 | | 9/2010 |
| JP | 2018185062 | A | | 11/2018 |

OTHER PUBLICATIONS

Notice of Acceptance for Australia Patent Application No. 2020346171 dated May 9, 2023 (3 pages).
European Search Report for EP Patent Application No. 20863124.2 dated Aug. 9, 2022 (4 pages).
1st Office Action for EP Patent Application No. 20863124.2 dated Aug. 19, 2022 (5 pages).
Notice of Intent to Grant EP Patent Application No. 20863124.2 dated Jan. 23, 2023 (35 pages).
Notification of Grant for China Patent Application 201910866595.1 dated Oct. 30, 2020 (4 pages).
1st Office Action for China Application No. 201910866595.1 dated Aug. 25, 2020 (9 pages).
International Search Report for PCT/CN2020/114255 (ISA/CN) mailed Dec. 4, 2020 with English translation (6 pages).
Written Opinion for PCT/CN2020/114255(ISA/CN) mailed Dec. 4, 2020 (4 pages).

* cited by examiner

REFRIGERATOR WITH IMPROVED EVAPORATOR INSTALLATION STRUCTURE

CROSS-REFERENCE TO RELATED APPLICATIONS

The present application is a national phase entry of International Application No. PCT/CN2020/114255, filed Sep. 9, 2020, which claims priority to Chinese Patent Application No. 201910866595.1, filed Sep. 12, 2019, which are each incorporated herein by reference in their entirety.

FIELD OF THE INVENTION

The present invention relates to the technical field of household appliances, and in particular, to a refrigerator with an improved evaporator installation structure.

BACKGROUND OF THE INVENTION

In the existing refrigerator, an evaporator is generally located at the rear part of a bottommost storage space, which reduces the front-rear direction volume of the storage space, limits the depth of the storage space, and makes the storage space inconvenient to place articles that are large and difficult to separate.

BRIEF DESCRIPTION OF THE INVENTION

In view of the above problems, an objective of the present invention is to provide a refrigerator that overcomes the above problems or at least partially solves the above problems.

A further objective of the present invention is to simplify the installation structure of an evaporator.

The present invention provides a refrigerator, including:

a refrigerator body, including a storage liner at a bottommost position;

a top cover, arranged to divide the storage liner into a storage space at the upper part and a cooling space at the lower part; and an evaporator, arranged in the cooling space and configured to cool an airflow entering the cooling space to form a cooling airflow; wherein the evaporator is placed on a bottom wall of the storage liner, and the bottom wall is provided with a limit structure at the front part and rear part of the evaporator respectively, to realize front and rear limits of the evaporator.

Optionally, the limit structures are ribs integrally formed with the storage liner.

Optionally, the limit structure at the front part of the evaporator includes: at least one first rib extending in the left-right direction; and the limit structure at the rear part of the evaporator includes: at least two second ribs in spaced arrangement and extending in the front-rear direction.

Optionally, the evaporator includes:

a main body part, used to cool the airflow entering the cooling space; and a lower cover plate, arranged below the main body part and including a cover body, a first extension portion and a second extension portion, wherein the cover body is attached to the main body part, and the first extension portion and the second extension portion are formed by extending upward or downward from the front and rear sides of the cover body respectively;

wherein the first extension portion and the second extension portion cooperate with the limit structures respectively to realize the front and rear limits.

Optionally, the first extension portion is formed by extending downward from the front side of the cover body; and the second extension portion is formed by extending upward from the rear side of the cover body.

Optionally, the evaporator further includes an upper cover plate arranged above the main body part, and at least two mounting holes arranged at intervals are formed on a front part of the upper cover plate;

the top cover is provided with at least two positioning pins arranged at intervals on the front side thereof; and the positioning pins are arranged corresponding to the mounting holes of the upper cover plate, and the positioning pins are adapted and fixed to the mounting holes of the upper cover plate to fix the evaporator with the top cover, so as to realize the front and rear, left and right limits of the evaporator.

Optionally, the storage liner further includes protrusions formed between left and right side walls and the bottom wall, and front end surfaces of the two protrusions are provided with at least one mounting hole respectively;

the top cover includes a top cover body and an extension portion extending downward from the front side of the top cover body, and the extension portion is provided with at least one mounting hole on the left and right sides thereof respectively; and the mounting holes of the extension portion are arranged corresponding to the mounting holes of the protrusions, and the top cover is fixed with the protrusions by fixing members, thereby further enhancing the fixation of the evaporator in the cooling space.

Optionally, the refrigerator further includes:

an air supply duct, arranged on the inner side of a rear wall of the storage liner, communicated with the cooling space, and configured to deliver at least part of the cooling airflow into the storage space;

the top cover further includes a supporting portion protruding upward from the rear end of the top cover body; and a bearing portion protruding forward is formed on a front wall surface of the air supply duct, and the top cover and the air supply duct are arranged such that the supporting portion supports the bearing portion to prevent the air supply duct from falling.

Optionally, the refrigerator further includes:

at least one return air hood, arranged at a front end of the top cover, and confining the cooling space together with the top cover and the bottom wall of the storage liner;

the return air hood includes:

a return air frame on the front side, a front wall surface of which is provided with a first opening, and a rear end of which is open; and a return air rear cover, inserted into the return air frame from the open rear end of the return air frame, and arranged to divide the first opening into a first front return air inlet at the upper part and a second front return air inlet at the lower part, to facilitate the back flow of return air in the storage space to the cooling space through the first front return air inlet and the second front return air inlet.

Optionally, the return air frame includes a first flow guide inclined section extending backward and upward from an upper end of the front wall surface of the return air frame, and a second flow guide inclined section extending backward and downward from a position near a lower end of the front wall surface of the return air frame;

the return air rear cover includes a third flow guide inclined section extending forward and downward from back to front, a fourth flow guide inclined section extending forward and downward from a lower end of the third flow guide inclined section, a fifth flow guide inclined section extending backward and downward from a front end of the fourth flow guide inclined section, and a sixth flow guide inclined section extending backward and downward from a lower end of the fifth flow guide inclined section;

the first flow guide inclined section, the third flow guide inclined section, and the fourth flow guide inclined section confine a first return air duct behind the first front return air inlet, and the third flow guide inclined section is provided with second openings; and the second flow guide inclined section and the sixth flow guide inclined section confine a second return air duct behind the second front return air inlet.

The bottommost space of the refrigerator of the present invention is a cooling space, which increases the height of the storage space above the cooling space, reduces user's bending when picking and placing articles in the storage space, and improves user experience; in addition, the evaporator is placed on the bottom wall of the storage liner, and the bottom wall is provided with a limit structure at the front part and rear part of the evaporator respectively, thereby realizing the front and rear limits of the evaporator with a simple and ingenious structure.

Further, in the refrigerator of the present invention, ribs integrally formed with the storage liner are used as the limit structures, which hardly affects the manufacturing process of the refrigerator and does not require additional steps of setting the limit structures.

Further, in the refrigerator of the present invention, the evaporator is fixed with the top cover, which realizes the front and rear, left and right limits of the evaporator; and preferably, the top cover is also fixed with the storage liner to further enhance the fixation of the evaporator in the cooling space.

Further, in the refrigerator of the present invention, the top cover and the air supply duct have specially designed structures, which avoids the falling of the air supply duct under external force, so that the installation of the air supply duct is more stable, and the refrigeration effect of the refrigerator can thus be ensured during the operation.

Further, in the refrigerator of the present invention, two return air inlets distributed up and down are formed on the front side of the return air hood, which is not only visually attractive, but also can effectively prevent children's fingers or foreign objects from entering the cooling space; and two return air areas distributed up and down can make the return air flow through the evaporator more uniformly after entering the cooling space, which can avoid the problem of easy frosting on the front end surface of the evaporator to a certain extent, improve the heat exchange efficiency, extend the defrosting cycle, save energy and achieve high efficiency.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the drawings, like reference numerals denote like or similar components or parts. Those skilled in the art should understand that these drawings are not necessarily drawn to scale. In the drawings.

DETAILED DESCRIPTION

This embodiment provides a refrigerator 100. The refrigerator 100 according to the embodiment of the present invention will be described below with reference to FIGS. 1 to 11. In the following description, the directions or positional relationships indicated by "front", "rear", "left", "right", "upper", "lower", "transverse", etc. are based on the directions referenced by the refrigerator 100 itself, "front" and "rear" are the directions indicated in FIG. 1, and as shown in FIG. 2, "transverse" refers to a direction parallel to the width direction of the refrigerator 100.

Figure 1:
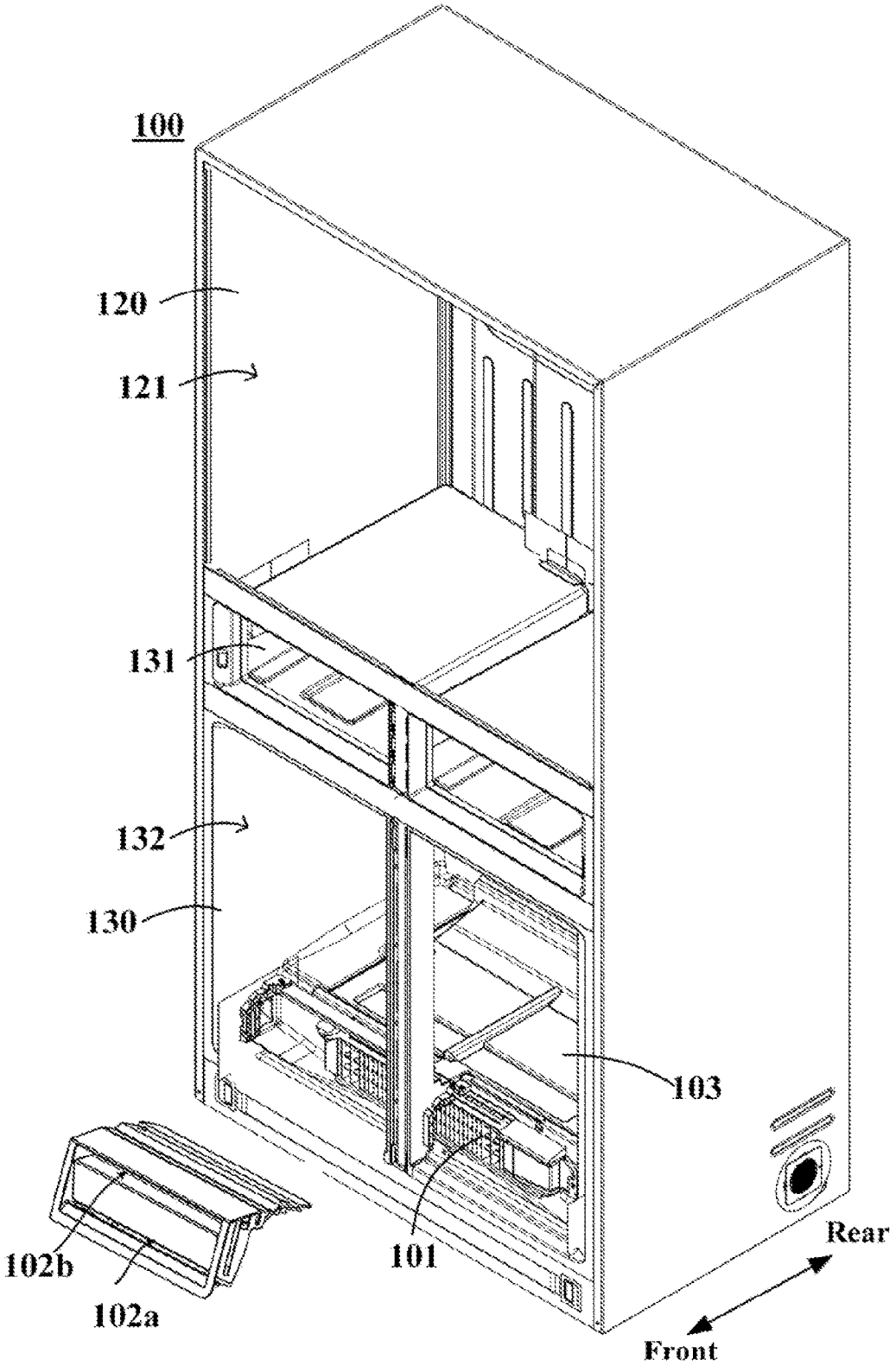
FIG. 1 is a schematic structural diagram of a refrigerator according to an embodiment of the present invention.
Figure 2:
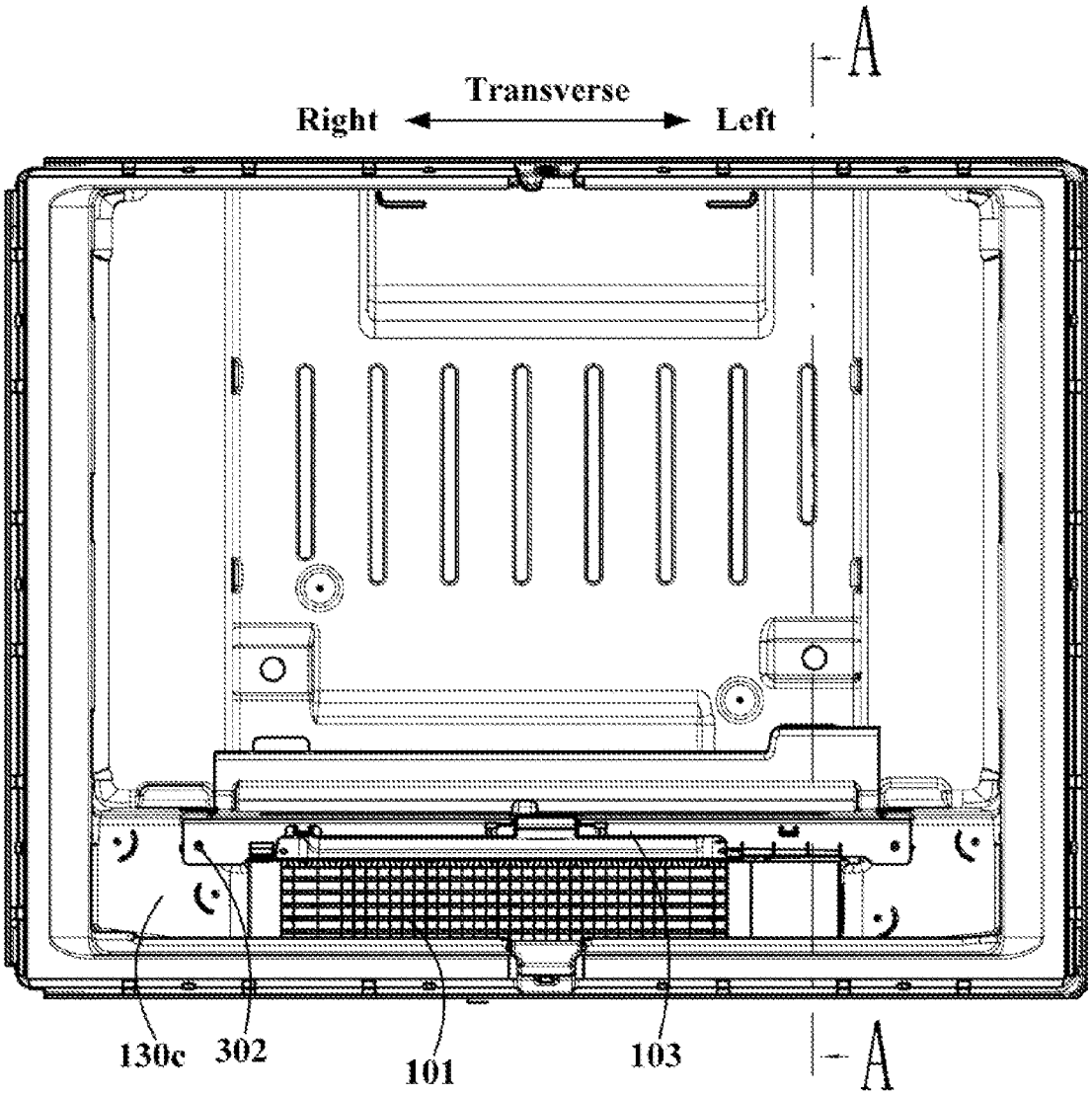
FIG. 2 is a front view after a storage liner, a top cover, an evaporator and other components of the refrigerator are combined according to an embodiment of the present invention.

As shown in FIG. 1, the refrigerator 100 may generally include a refrigerator body, the refrigerator body includes a housing and at least one storage liner arranged inside the housing, the space between the housing and the storage liner is filled with a thermal insulation material (to form a foamed layer), a storage space is confined in the storage liner, and a corresponding door is further arranged on the front side of each storage liner to open and close the corresponding storage space. The bottommost storage liner 130 may be a freezing liner, and correspondingly, the storage space 132 is a freezing space. As shown in FIG. 1, there are a plurality of storage liners, respectively a bottommost storage liner 130, two variable-temperature liners 131 distributed transversely above the storage liner 130, and a refrigeration liner 120 above the two variable-temperature liners 131. A variable-temperature space is confined in each variable-temperature liner 131, and a refrigeration space 121 is confined in the refrigeration liner 120. As is well known by those skilled in the art, the temperature in the refrigeration space 121 is generally between 2° C. and 10° C., and preferably between 4° C. and 7° C. The temperature range in the freezing space is generally −22° C. to −14° C. The variable-temperature space can be randomly adjusted to −18° C. to 8° C. The optimal storage temperatures for different types of articles are different, and the suitable storage locations are also different. For example, vegetable foods are suitable for storage in the refrigeration space 121, and meat foods are suitable for storage in the freezing space. As can be realized by those skilled in the art, the refrigerator 100 in this embodiment may further include an evaporator 101, a blower 104, a compressor (not shown), a condenser (not shown), a throttling element (not shown), etc. The evaporator 101 is connected to the compressor, the condenser, and the throttling element via a refrigerant pipeline to form a refrigeration circulation loop, and cools down when the compressor is started to cool the air flowing through it.

Particularly, in this embodiment, the refrigerator 100 further includes a top cover 103, which is arranged to divide the bottommost storage liner 130 into a storage space 132 at the upper part and a cooling space at the lower part, and the evaporator 101 is arranged in the cooling space.

In a traditional refrigerator 100, the bottommost space of the refrigerator 100 is generally a storage space. Because the storage space is at a relatively low position, a user needs to bend over or squat down to pick and place articles in the bottommost storage space, which is inconvenient for users, especially the elderly to use. In addition, because an evaporator occupies the rear area of the bottommost storage space, the depth of the bottommost storage space is reduced. Moreover, because a compressor chamber is generally located at the rear part of the bottommost storage space, the bottommost storage space inevitably has to give way to the compressor chamber, resulting in an abnormal shape of the bottommost storage space, which is inconvenient for the storage of articles that are large and difficult to separate. In the refrigerator 100 of this embodiment, the bottommost space of the refrigerator 100 is a cooling space, which increases the height of the storage space 132 above the cooling space, reduces user's bending when picking and placing articles in the storage space 132, and improves user experience. In addition, the depth of the storage space 132 is ensured; and the compressor chamber can be located at the lower rear part of the storage space 132, and the storage space 132 no longer needs to give way to the compressor chamber, thus presenting a large and regular rectangular space, which facilitates the placement of articles that are large and difficult to separate, and can solve the pain point of not being able to place large articles in the storage space 132.

The evaporator 101 cools an airflow entering the cooling space to form a cooling airflow. At least part of the cooling airflow is delivered to the storage space 132 through an air supply duct 141. The air supply duct 141 may be arranged on the inner side of the rear wall of the storage liner 130 and connected to the cooling space. The air supply duct 141 is provided with a plurality of air supply outlets communicated with the storage space 132.

The refrigerator 100 further includes a variable-temperature air duct (not shown) that delivers the cooling airflow to the variable-temperature space. The variable-temperature air duct can be controlled to connect the air supply duct 141 through a variable-temperature air door (not shown), so as to guide part of the cooling airflow in the air supply duct 141 into the variable-temperature air duct. The refrigerator 100 may further include a refrigeration air duct (not shown) that delivers the cooling airflow to the refrigeration space. The refrigeration air duct can be controlled to connect the air supply duct 141 through a refrigeration air door, so as to guide part of the cooling airflow in the air supply duct 141 into the refrigeration air duct. In some alternative embodiments, another evaporator may be arranged in the refrigeration liner 120 to cool the refrigeration space 121 by means of air cooling or direct cooling, so as to form a refrigerator 100 with a dual refrigeration system to prevent odor crossing between the storage space 132 and the refrigeration space 121.

Figure 3:
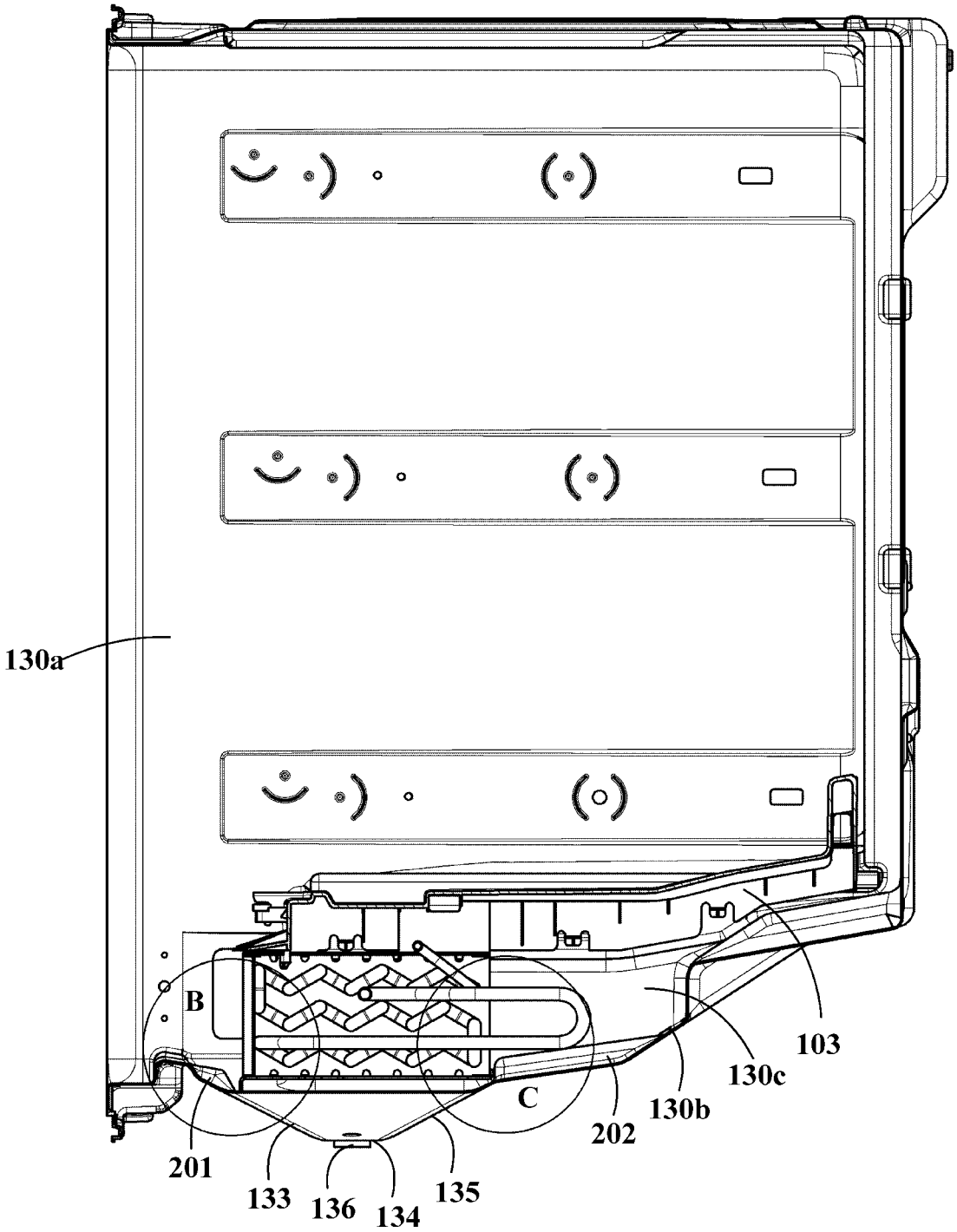
FIG. 3 is a cross-sectional view taken along line A-A in FIG. 2.

As shown in FIG. 3, in an embodiment of the present invention, the evaporator 101 is placed on a bottom wall **130*b* of the storage liner 130, and the bottom wall 130*b* forms a limit structure 200 at the front part and the rear part of the evaporator 101 respectively, to realize front and rear limits of the evaporator 101. The installation of the evaporator 101 in the refrigerator body requires consideration of front and rear, left and right, up and down limits. In the prior art, positioning structures are usually arranged on the front and rear, left and right, upper and lower sides of the evaporator 101 to fix the evaporator 101, which causes the installation process of the evaporator 101 to be very complicated. Meanwhile, the structure of the refrigerator body also requires many adjustments to cooperate with the positioning structures of the evaporator 101 itself, which also causes the complexity of the manufacturing process and the increase in cost. However, in the present invention, it is proposed to directly place the evaporator 101 on the bottom wall 130*b* of the storage liner 130 to achieve installation in the up-down direction. Meanwhile, the bottom wall 130*b* forms a limit structure 200 at the front part and the rear part of the evaporator 101 respectively, so as to realize front and rear limits of the evaporator 101** with a simple structure, and realize an ingenious structure and simple assembly.

Figure 4:
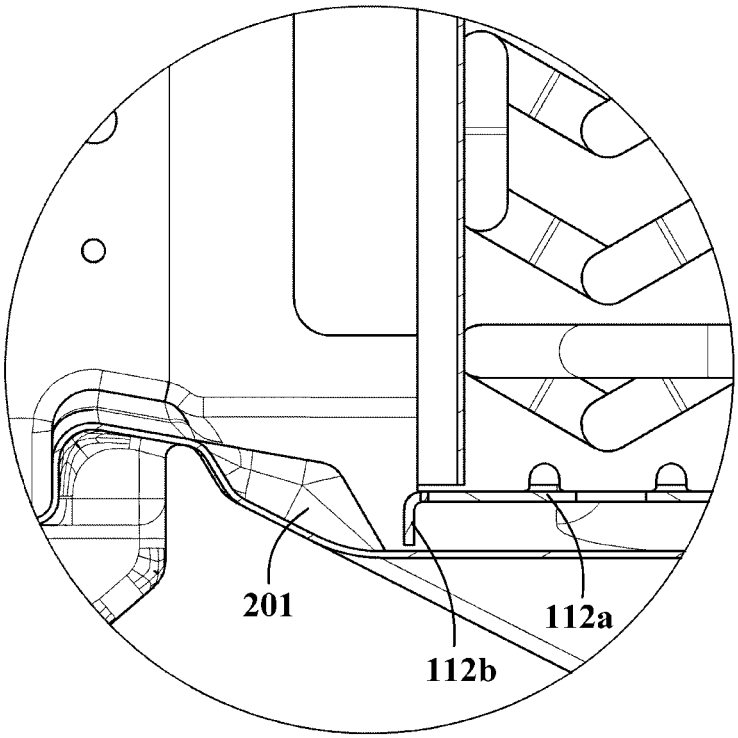
FIG. 4 is an enlarged schematic diagram of part B in FIG. 3.
Figure 5:
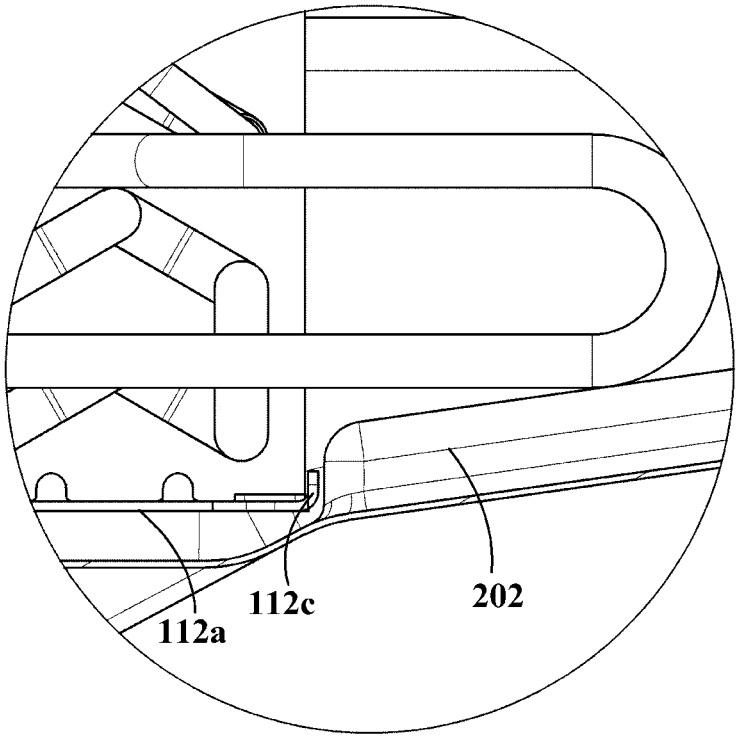
FIG. 5 is an enlarged schematic diagram of part C in FIG. 3.

In some embodiments, the limit structures 200 are ribs integrally formed with the storage liner 130. The limit structures 200 may be formed by adding limit members to the bottom wall **130*b*, and preferably, the limit structures 200 are formed by ribs integrally formed with the storage liner 130, which hardly affects the manufacturing process of the refrigerator and does not require additional steps of setting the limit structures 200. As shown in FIGS. 3 to 5, in the refrigerator of the present invention, the limit structure 200 at the front part of the evaporator 101 includes: a first rib 201 extending in the left-right direction; and the limit structure 200 at the rear part of the evaporator 101 includes: two second ribs 202** in spaced arrangement extending in the front-rear direction.

Figure 8:
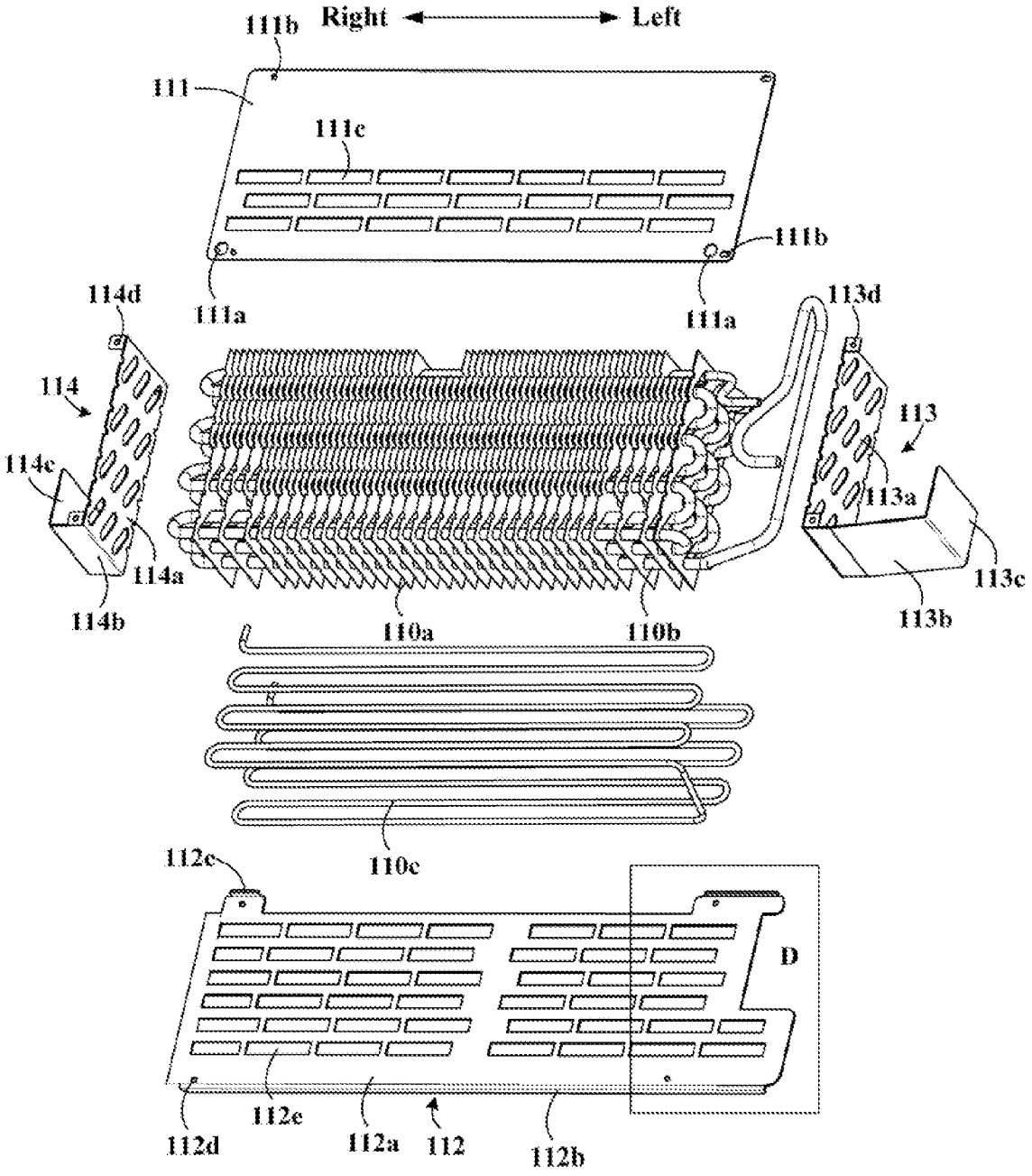
FIG. 8 is an exploded schematic diagram of the evaporator of the refrigerator according to an embodiment of the present invention.
Figure 9:
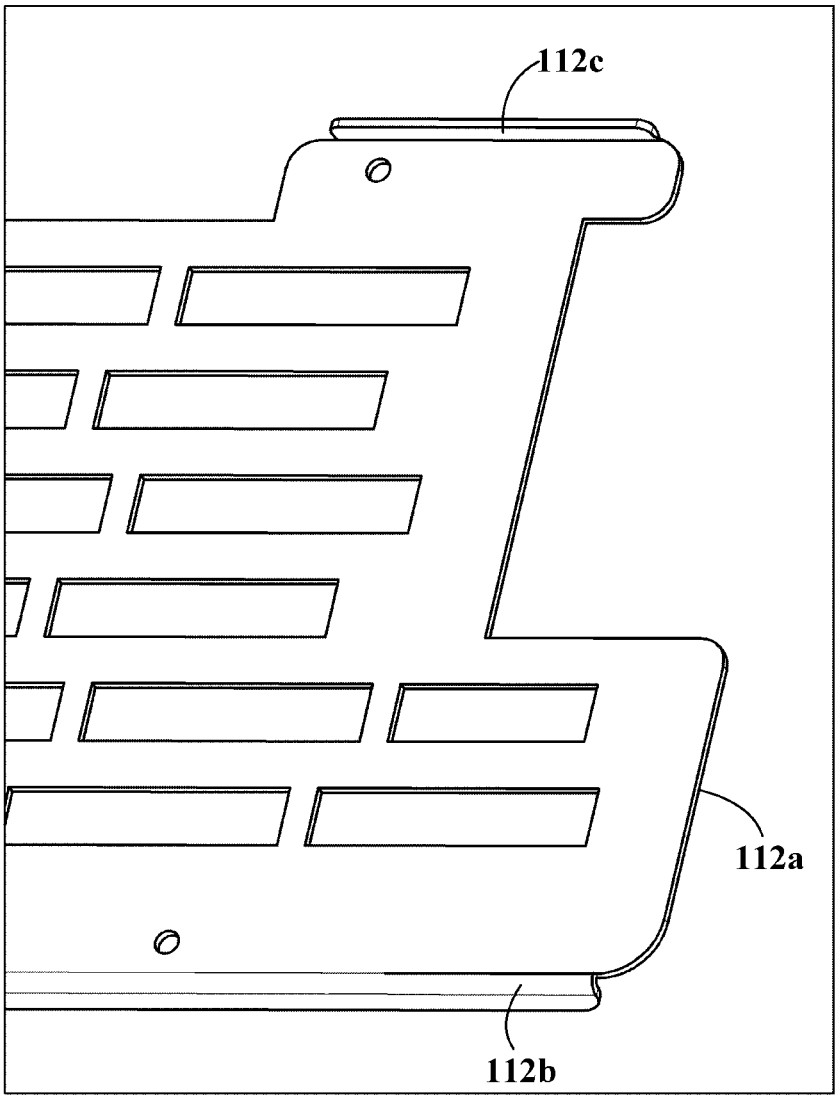
FIG. 9 is an enlarged schematic diagram of part D in FIG. 8.

As shown in FIGS. 8 and 9, the evaporator 101 of the refrigerator of the present invention includes: a main body part 110, an upper cover plate 111, a lower cover plate 112, a left end plate 113 and a right end plate 114. The evaporator 101 may be a fin-tube evaporator 101, and the main body part 110 includes a plurality of fins **110*a* arranged in parallel, a coil 110*b* passing through the fins 110*a*, and a heating wire 110*c* passing through the fins 110*a*. The upper cover plate 111, the lower cover plate 112, the left end plate 113 and the right end plate 114 are sequentially arranged at the upper, lower, left and right parts of the main body part 110. The evaporator 101 can be modularized by fixing four sides of the main body part 110** with cover plates.

The lower cover plate 112 is arranged at the lower part of the main body part 110, and includes a cover body 112*a*, a first extension portion 112*b* and a second extension portion 112*c*. The cover body 112*a* is attached to the main body part 110. Four corners of the cover body are provided with fixing holes 112*d*, and the middle part of the cover body is provided with a plurality of drainage holes 112*e*. The first extension portion 112*b* is formed by extending downward from the front side of the cover body 112*a*, and the second extension portion 112*c* is formed by extending upward from the rear side of the cover body 112*a*. As shown in FIGS. 4 and 5, the first extension portion 112*b* cooperates with the first rib 201, and the second extension portion 112*c* cooperates with the second ribs 202, to realize the front and rear limits of the evaporator 101. Defrosted water and condensate water flow to a lower water receiving section via the drainage holes 112*e*. As shown in FIG. 3, the water receiving section is formed below the evaporator 101. The projection of the water receiving section on a vertical plane parallel to a side wall 130*a* of the storage liner 130 includes a front flow guide inclined section 133 extending backward and downward and located at a front side, a horizontal straight section 134 extending horizontally backward from the front flow guide inclined section 133, and a rear flow guide inclined section 135 extending backward and upward from the rear end of the horizontal straight section 134. The horizontal straight section 134 is provided with a water outlet 136. The condensate water on the evaporator 101 flows along the front flow guide inclined section 133 and the rear flow guide inclined section 135 respectively to the horizontal straight section 134, and is discharged from the water outlet 136. The water outlet 136 is connected with a drain pipe (not shown), and the condensate water is guided to an evaporating dish of the refrigerator 100 through the drain pipe. The evaporating dish can generally be located in a compressor chamber to evaporate the water in the evaporating dish by means of heat of the condenser and/or compressor arranged in the compressor chamber.

Figure 6:
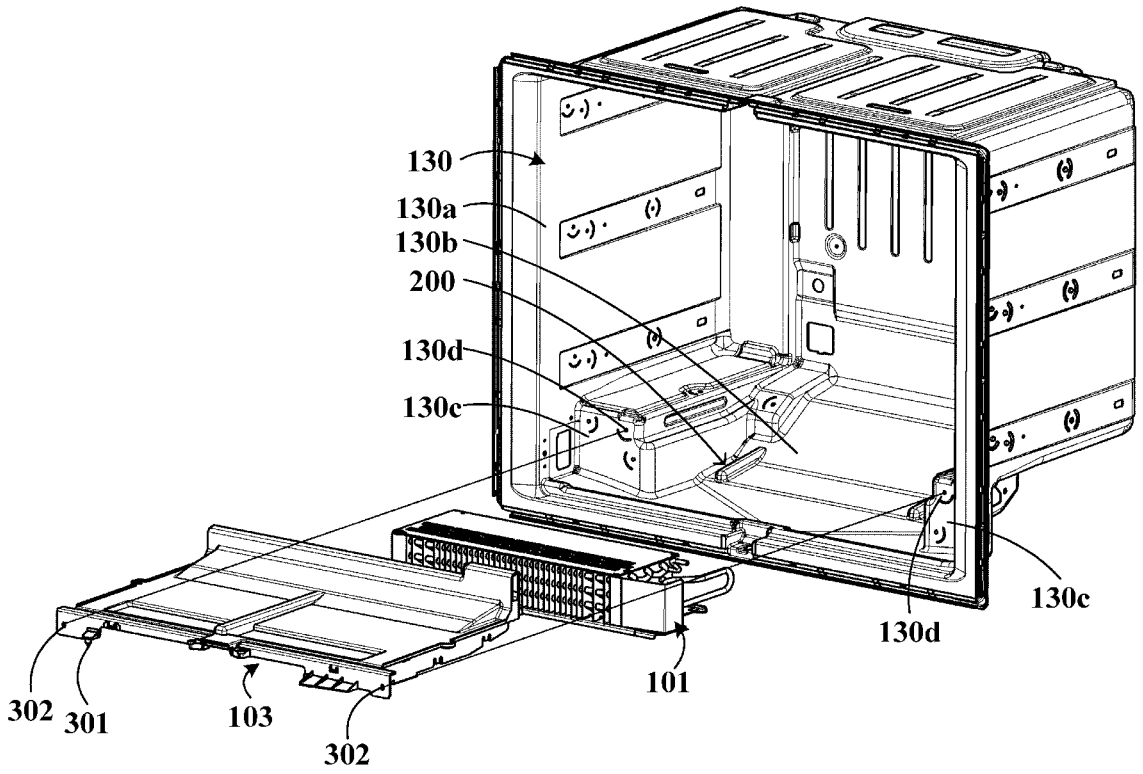
FIG. 6 is an exploded schematic diagram of the storage liner, the top cover, and the evaporator of the refrigerator according to an embodiment of the present invention.
Figure 7:
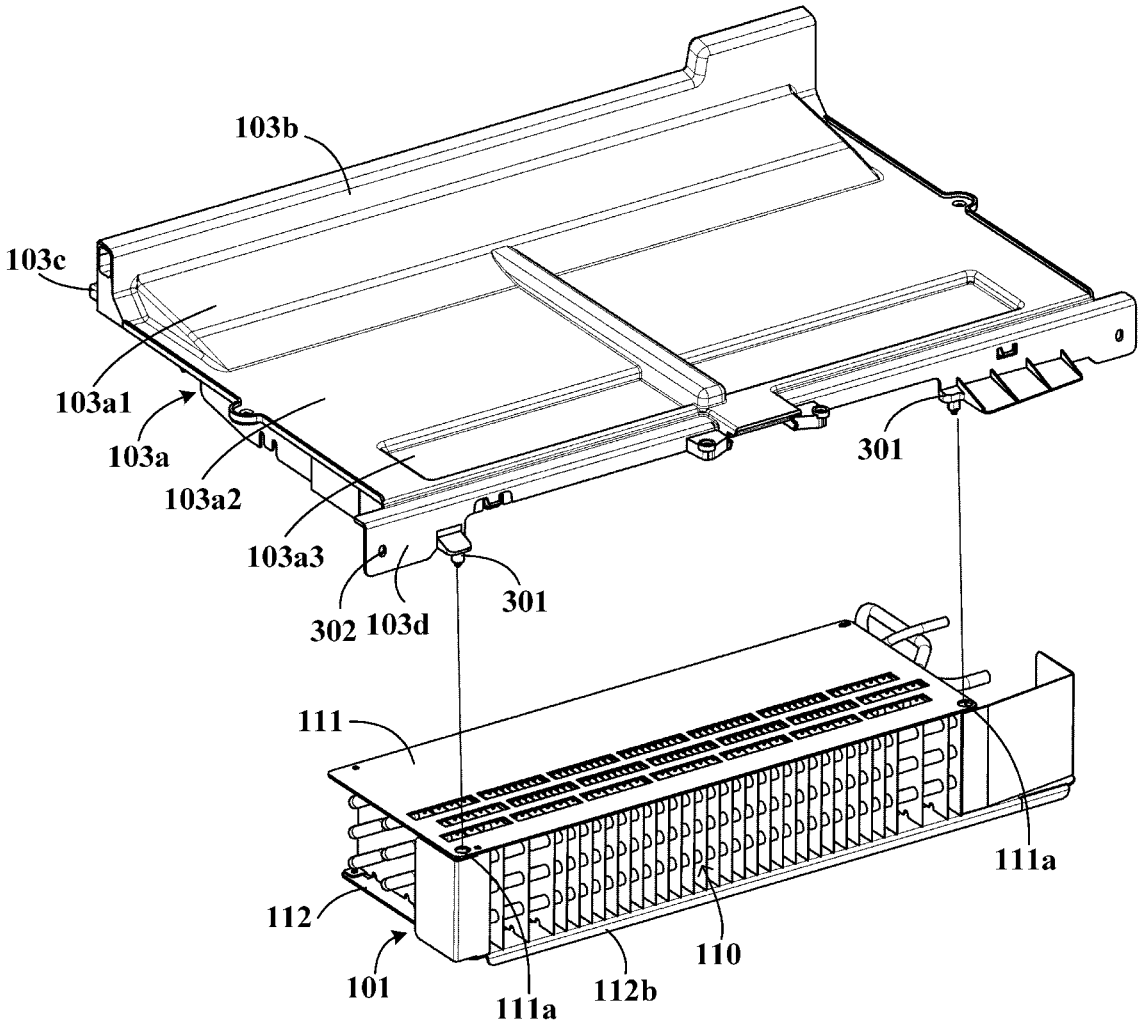
FIG. 7 is an exploded schematic diagram of the top cover and the evaporator of the refrigerator according to an embodiment of the present invention.

The upper cover plate 111 is arranged above the main body part 110, and two mounting holes 111*a* in spaced arrangement are formed on the left and right sides of the front part of the upper cover plate. As shown in FIGS. 6 and 7, the top cover 103 is provided with two positioning pins 301 in spaced arrangement on the front side thereof. The positioning pins 301 are arranged corresponding to the mounting holes 111*a* of the upper cover plate 111. The positioning pins 301 are adapted and fixed to the mounting holes 111*a* of the upper cover plate 111 to fix the evaporator 101 with the top cover 103, so as to realize the front and rear, left and right limits of the evaporator 101. The front part of the upper cover plate 111 is further provided with a plurality of vent holes 111*c*, and air flow entering the cooling space can pass through the vent holes 111*c* to reach the main body part 110 for cooling. Similarly, the four corners of the upper cover plate 111 are provided with fixing holes 111*b* respectively. In order to show the connection relationship between the top cover 103 and the evaporator 101 in FIG. 7, connection lines between the positioning pins 301 of the top cover 103 and the mounting holes 111*a* of the upper cover plate 111 are shown.

The left end plate 113 is substantially U-shaped, and has a fixed portion 113*a*, a front end portion 113*b*, and an extension portion 113*c* connected in sequence. The fixed portion 113*a* is in a shape similar to the fins 110*a*, in contact with the main body part 110, and provided with fixing holes 113*d*. The front end portion 113*b* is formed by extending leftward from the fixed portion 113*a*, and the extension portion 113*c* is formed by extending backward from the front end portion 113*b*. A space among the fixed portion 113*a*, the front end portion 113*b* and the extension portion 113*c* is used to provide a return air pipe connecting pipeline. The fixing holes 113*d* of the left end plate 113, the fixing holes 111*b* of the upper cover plate 111, and the fixing holes 112*d* of the lower cover plate 112 are fixed by screws to realize the assembly of the left end plate 113.

The right end plate 114 is substantially U-shaped, and has a fixed portion 114*a*, a front end portion 114*b* and an extension portion 114*c* connected in sequence. The fixed portion 114*a* is in a shape similar to the fins 110*a*, in contact with the main body part 110, and provided with fixing holes 114*d*. The front end portion 114*b* is formed by extending leftward from the fixed portion 114*a*, and the extension portion 114*c* is formed by extending backward from the front end portion 114*b*. The fixing holes 114*d* of the right end plate 114, the fixing holes 111*b* of the upper cover plate 111, and the fixing holes 112*d* of the lower cover plate 112 are fixed by screws to realize the assembly of the right end plate 114.

As shown in FIG. 1, the storage liner 130 of the refrigerator 100 of the present invention further includes two protrusions 130*c* formed between the left and right side walls 130*a* and the bottom wall 130*b*, and front end surfaces of the two protrusions 130*c* are respectively provided with a mounting hole 130*d*. The top cover 103 includes a top cover body 103*a* and an extension portion 103*d* extending downward from the front side of the top cover body 103*a*. The extension portion 103*d* is provided with a mounting hole 302 on the left and right sides thereof respectively. The mounting holes 302 of the extension portion 103*d* are arranged corresponding to the mounting holes 130*d* of the protrusions 130*c*. The top cover 103 is fixed with the protrusions 130*c* by fixing members, thereby further enhancing the fixation of the evaporator 101 in the cooling space. In order to show the connection relationship between the top cover 103 and the storage liner 130 in FIG. 6, connection lines between the mounting holes 302 of the top cover 103 and the mounting holes 130*d* of the storage liner 130 are shown.

When installing, the evaporator 101 is first placed on the bottom wall 130*b* of the storage liner 130, and limited on the front and rear by means of the first rib 201 and the second ribs 202; then, the top cover 103 is buckled on the evaporator 101, the positioning pins 301 are inserted into the mounting holes 111*a* of the upper cover plate 111 of the evaporator 101 to limit the left and right, front and rear positions; and finally, the top cover 103 is fixed to the protrusions 130*c* on both sides by screws to further fix the evaporator 101 while limiting the air supply duct 141.

Figure 10:
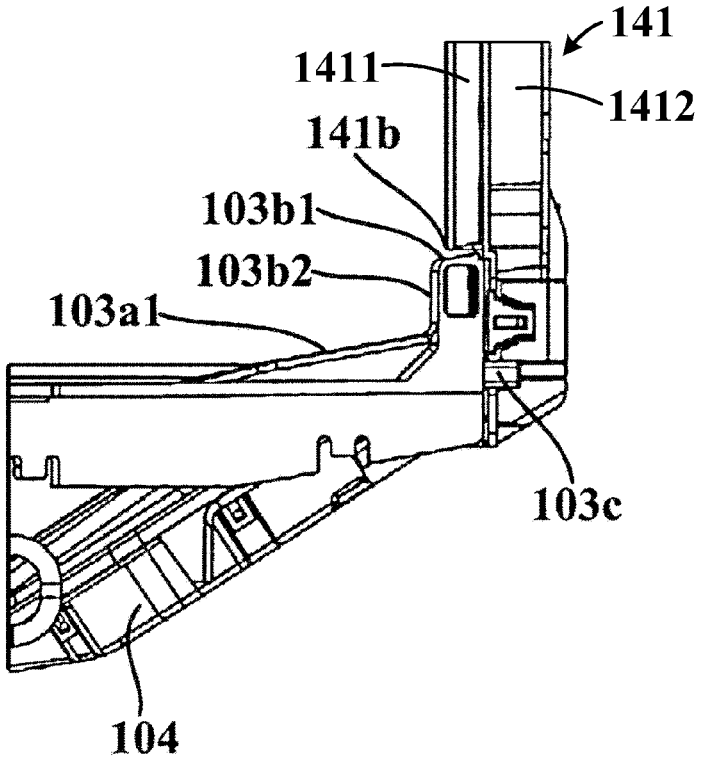
FIG. 10 is a partial side view after an air supply duct, the top cover and a blower of the refrigerator are combined according to an embodiment of the present invention.

Further in particular, as shown in FIGS. 7 and 10, the top cover 103 further includes a supporting portion 103*b* protruding upward from the rear end of the top cover body 103*a*, and the front wall surface of the air supply duct 141 is provided with a bearing portion 141*b* protruding forward. When the top cover 103 and the air supply duct 141 are assembled, the supporting portion 103*b* supports the bearing portion 141*b* to prevent the refrigerator 100 from being collided during transportation to cause the falling of the air supply duct 141. The top end of the air supply duct 141 usually passes through the top wall of the storage liner 130 to communicate with air ducts that supply air to other storage spaces (for example, the variable-temperature air duct (not shown) that supplies air to the variable-temperature space above the bottommost storage liner 130). Specifically, the top end of the air supply duct 141 is provided with a first top opening, and the top wall of the storage liner 130 is provided with a second top opening corresponding to the first top opening in a one-to-one manner, so that the first top opening is communicated with an air inlet of the variable-temperature air duct through the second top opening. An air door may be arranged at the first top opening of the air supply duct 141 to open and close the first top opening in a controlled manner. The refrigerator 100 is inevitably collided during the carrying process, which easily causes the falling of the air supply duct 141. Once the air supply duct 141 falls, a gap appears between the first top opening at the top end of the air supply duct 141 and the corresponding second top opening of the top wall of the storage liner 130. During the operation of the refrigerator 100, air flows between the variable-temperature space and the storage space 132 below, which affects the temperature of the storage space 132 and the variable-temperature space, and easily causes frosting nearby the top end of the air supply duct 141 to affect the delivery of the cooling airflow and reduce the refrigeration effect. In this embodiment, the top cover 103 and the air supply duct 141 are specially designed as above, which can avoid the falling of the air supply duct 141 under an external force, so that the installation of the air supply duct 141 is more stable, and the refrigeration effect of the refrigerator 100 can thus be ensured during the operation.

As shown in FIG. 10, the air supply duct 141 includes a front air duct cover plate 1411 and a rear air duct cover plate 1412 located on the rear side of the front air duct cover plate 1411. Correspondingly, the front air duct cover plate 1411 constitutes a front wall surface of the air supply duct 141, that is, the front air duct cover plate 1411 is provided with the aforementioned bearing portion 141*b*; and the front air duct cover plate 1411 and the rear air duct cover plate 1412 confine a passage communicated with the cooling space. The front air duct cover plate 1411 and the rear air duct cover plate 1412 are fixed by a screw passing through the center of the air supply duct 141, and a screw passing hole is formed at the approximate center of the front air duct cover plate 1411. A screw stud is formed at the approximate center of the rear air duct cover plate 1412. The front air duct cover plate 1411 and the rear air duct cover plate 1412 are adapted and locked by the screw passing through the screw passing hole and the screw stud, so that the front air duct cover plate 1411 and the rear air duct cover plate 1412 are assembled together. The aforementioned special design structure for preventing the falling of the air supply duct 141 also avoids the problem that the front air duct cover plate 1411 moves down when the screw is loose.

Further in particular, the bearing portion 141*b* extends obliquely downward from back to front, the upper end surface of the supporting portion 103*b* includes a first inclined section 103*b*1 extending obliquely downward from back to front, and the condensate water can flow forward and downward along the inclined surface of the bearing portion 141*b* and the inclined surface of the first inclined section 103*b*1 to the top cover body 103*a*. The front end surface of the supporting portion 103*b* may include a vertical section 103*b*2 extending vertically, the vertical section 103*b*2 is connected to the first inclined section 103*b*1 through a first transition section, and the vertical section 103*b*2 guides the condensate water sliding off along the first inclined section 103*b*1 to the top cover body 103*a*.

As shown in FIG. 7, the upper surface of the top cover body 103*a* may include a second inclined section 103*a*1 extending obliquely downward from back to front, and the second inclined section 103*a*1 is connected to the vertical section 103*b*2 through a second transition section to further guide the condensate water. The upper surface of the top cover body 103*a* may further include a horizontal section 103*a*2 extending forward from the front end of the second inclined section 103*a*1, and the horizontal section 103*a*2 is provided with at least one water collecting trough 103*a*3 to collect the condensate water flowing down from the second inclined section 103*a*1, which facilitates the user to clean the condensate water in a centralized manner. In this way, the flow guide and drainage functions are realized by the special structure of the top cover 103.

A positioning protrusion 103*c* protruding backward is formed at the rear end of the top cover 103, and a positioning groove (not shown) corresponding to and adapted to the positioning protrusion 103*c* in a one-to-one manner is formed on the rear wall of the storage liner 130. Two positioning protrusions 103*c* may be formed, and the two positioning protrusions 103*c* are near two lateral sides of the rear end of the top cover 103 respectively, and are both located below the supporting portion 103*b*. Accordingly, the top cover 103 is assembled on the storage liner 130.

Figure 11:
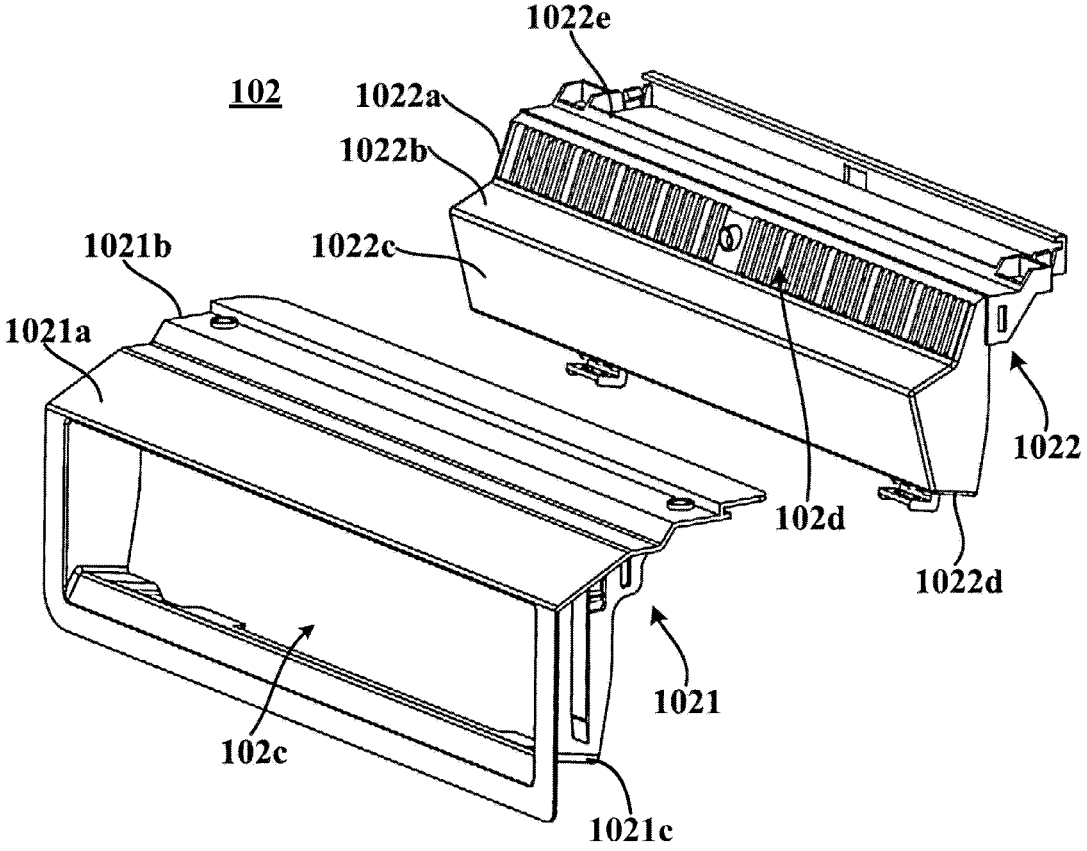
FIG. 11 is an exploded schematic diagram of a return air frame and a return air rear cover of the refrigerator according to an embodiment of the present invention.

In some embodiments, as shown in FIG. 11, the blower 104 is located behind the evaporator 101, and its air outlet end is connected to the air inlet end of the air supply duct 141. The blower is configured to promote the cooling airflow into the air supply duct 141, to accelerate the air circulation and increase the refrigeration speed. The blower 104 may be a centrifugal fan, an axial flow fan, or a cross flow fan. In this embodiment, the blower 104 is a centrifugal fan, the blower 104 is arranged obliquely upward from front to back, and the blower 104 is detachably connected to the air supply duct 141. When the refrigerator 100 is assembled, the rear air duct cover plate 1412 is first assembled with the blower 104, the front air duct cover plate 1411 is assembled with the blower 104, and then the top cover 103 is installed on the storage liner 130. The positions of the rear air duct cover plate 1412, the front air duct cover plate 1411 and the top cover 103 satisfy that the supporting portion 103*b* of the top cover 103 supports the bearing portion of the front air duct cover plate 1411.

As shown in FIGS. 1 and 11, the refrigerator 100 further includes at least one return air hood 102, which is arranged at the front end of the top cover 103, and confines the aforementioned cooling space together with the top cover 103 and the bottom wall 130*b* of the storage liner 130. Each return air hood 102 includes a return air frame 1021 on the front side and a return air rear cover 1022. The front wall surface of the return air frame 1021 is provided with a first opening 102*c*, and the rear end of the return air frame is open. The return air rear cover 1022 is inserted into the return air frame 1021 from an open position at the rear end of the return air frame 1021, and is arranged to divide the first opening 102*c* into a first front return air inlet 102*b* at the upper part and a second front return air inlet 102*a* at the lower part, to facilitate return air in the storage space 132 flowing back to the cooling space through the first front return air inlet 102*b* and the second front return air inlet 102*a* to be cooled by the evaporator 101, thereby forming air circulation between the storage space 132 and the cooling space. In this embodiment, two return air inlets (the first front return air inlet 102*b* and the second front return air inlet 102*a*) distributed up and down are formed on the front side of the return air hood 102, which is not only visually attractive, but also can effectively prevent children's fingers or foreign objects from entering the cooling space; and two return air areas distributed up and down can make the return air flow through the evaporator 101 more uniformly after entering the cooling space, which can avoid the problem of easy frosting on the front end surface of the evaporator 101 to a certain extent, improve the heat exchange efficiency, extend the defrosting cycle, save energy and achieve high efficiency.

Generally, there are two return air hoods 102, and the two return air hoods 102 are distributed transversely with a spacing therebetween. A vertical beam is arranged between the two return air hoods 102, and the vertical beam extends vertically upward to the top wall of the storage liner 130 to separate the front side of the storage liner 130 into two transversely distributed areas. Two side-by-side doors (not shown) may be arranged on the front side of the storage liner 130, and the two doors are respectively used for opening and closing the two areas separated by the vertical beam.

Further in particular, as shown in FIG. 11, the return air frame 1021 includes a first flow guide inclined section 1021*a* extending backward and upward from the upper end of the front wall surface of the return air frame 1021, and a second flow guide inclined section 1021*c* extending backward and downward from a position near the lower end of the front wall surface of the return air frame 1021; and the return air rear cover 1022 includes a third flow guide inclined section 1022*a* extending forward and downward from back to front, a fourth flow guide inclined section 1022*b* extending forward and downward from the lower end of the third flow guide inclined section 1022*a*, a fifth flow guide inclined section 1022*c* extending backward and downward from the front end of the fourth flow guide inclined section 1022*b*, and a sixth flow guide inclined section 1022*d* extending backward and downward from the lower end of the fifth flow guide inclined section 1022*c*.

The first flow guide inclined section 1021*a*, the third flow guide inclined section 1022*a*, and the fourth flow guide inclined section 1022*b* confine a first return air duct (not numbered) behind the first front return air inlet 102*b*, and the third flow guide inclined section 1022*a* is provided with the second openings 102*d*. Return air entering from the first front return air inlet 102*b* enters the cooling space via the first return air duct and the second openings 102*d*, and enters the evaporator 101 from the upper section of the evaporator 101 to exchange heat with the evaporator 101. The second openings 102*d* are in the shape of vertical bars, and the plurality of second openings 102*d* are sequentially distributed in the transverse direction to disperse the return air, so that the return air enters the upper section of the evaporator 101 more uniformly. The second flow guide inclined section 1021*c* and the sixth flow guide inclined section 1022*d* confine a second return air duct (not numbered) behind the second front return air inlet 102*a*. Return air entering from the second front return air inlet 102*a* enters the cooling space via the second return air duct, and enters the evaporator 101 from the lower section of the evaporator 101 to exchange heat with the evaporator 101. The return air enters the cooling space through the upper and lower return air ducts, so that the return air passes through the evaporator 101 more uniformly, to improve the heat exchange efficiency. In addition, the design of each inclined section of the return air frame 1021 and the design of each inclined section of the return air rear cover 1022 guide the condensate water condensed on the return air hood 102 to facilitate drainage.

The sixth flow guide inclined section 1022*d* may be provided with a plurality of third openings (not shown) sequentially distributed in the transverse direction. The return air passing through the second return air duct is shunted by the respective third openings and then enters the cooling space, so that the return air enters the lower section of the evaporator 101 more uniformly. The sixth flow guide inclined section 1022*d* is provided with two mounting portions distributed transversely with a spacing therebetween. Correspondingly, the second flow guide inclined section 1021*c* of the return air frame 1021 is provided with mating portions mating the corresponding mounting portions to assemble the return air frame 1021 and the return air rear cover 1022.

As shown in FIGS. 2 and 3, the lower surface of the top cover 103 is spaced from the upper surface of the evaporator 101, and the front end of the top cover 103 is located at the rear upper part of the front end of the evaporator 101, that is, the top cover 103 does not completely shield the upper surface of the evaporator 101, the front section of the upper surface of the evaporator 101 is not shielded by the top cover 103, and the vent holes 111*c* are exposed. The return air rear cover 1022 further includes a shielding portion (denoted as a first shielding portion 1022*e*) extending backward and upward from the third flow guide inclined section 1022*a* to the front end of the top cover 103, the first shielding portion 1022*e* is configured to shield the section of the upper surface of the evaporator 101 that is not shielded by the top cover 103, and the first shielding portion 1022*e* is spaced from the upper surface of the evaporator 101 to form an air flow bypass communicated with the second openings 102*d*. At least part of the return air entering through the second openings 102*d* can enter the evaporator 101 from the vent holes 111*c* at the upper part of the evaporator 101 via the air flow bypass. In addition, the space between the top cover 103 and the upper surface of the evaporator 101 opposite to the top cover is filled with air shield foam, that is, the rear part of the air flow bypass is filled with the air shield foam, so that the return air passing through the air flow bypass all flows into the evaporator 101. This ensures that even when the front end surface of the evaporator 101 is frosted, return air still enters the evaporator 101 to exchange heat with it, thereby ensuring the refrigeration effect of the evaporator 101, solving the problem of reduction in the refrigeration effect due to frosting on the front end surface of the evaporator 101 in the existing refrigerator 100, and improving the refrigeration performance of the refrigerator 100.

The return air frame 1021 further includes a second shielding portion 1021*b* bent and extending backward and upward from the first flow guide inclined section 1021*a* to the top cover 103. The second shielding portion 1021*b* completely shields the first shielding portion 1022*e* to maintain the attractive appearance of the return air hood 102. Further in particular, the junction of the fourth flow guide inclined section 1022*b* and the fifth flow guide inclined section 1022*c* is located below the first flow guide inclined section 1021*a*. Condensate water formed in the return air frame 1021 drips right down to the junction of the fourth flow guide inclined section 1022*b* and the fifth flow guide inclined section 1022*c* below (that is, the corner between the fourth flow guide inclined section 1022*b* and the fifth flow guide inclined section 1022*c*) along the inclined surface of the first flow guide inclined section 1021*a*, and then drips to the second flow guide inclined section 1021*c* along the inclined surface of the fifth flow guide inclined section 1022*c*, and flows to the lower part of the evaporator 101. A water receiving area is generally provided under the evaporator 101, and the water receiving area is provided with a water outlet to drain the condensate water. In this way, the condensate water formed on the return air hood 102 is guided and drained, so as to avoid the sound of water droplets perceivable by human ears, and improve the user experience. The condensate water formed on the return air hood 102 is guided by the respective inclined sections of the return air frame 1021 and the return air rear cover 1022, flows along the front flow guide inclined section 133 to the horizontal straight section 134, and is finally drained by the water outlet 136.

So far, those skilled in the art should realize that although multiple exemplary embodiments of the present invention are illustrated and described in detail herein, many other variations or modifications that conform to the principle of the present invention may still be directly determined or derived from the disclosure of the present invention without departing from the spirit and scope of the present invention. Therefore, the scope of the present invention should be understood and deemed to cover all these other variations or modifications.

What is claimed is:

1. A refrigerator, comprising:

a refrigerator body, comprising a storage liner at a bottommost position;

a top cover, arranged to divide the storage liner into a storage space at the upper part and a cooling space at the lower part; and an evaporator, arranged in the cooling space and configured to cool an airflow entering the cooling space to form a cooling airflow;

wherein the evaporator is placed on a bottom wall of the storage liner, and the bottom wall is provided with a limit structure at the front part and rear part of the evaporator respectively, to realize front and rear limits of the evaporator;

wherein the evaporator comprises:

a main body part, used to cool the airflow entering the cooling space; and a lower cover plate, arranged below the main body part and comprising a cover body, a first extension portion and a second extension portion, wherein the cover body is attached to the main body part, and the first extension portion and the second extension portion are formed at the front and rear sides of the cover body respectively; and wherein the first extension portion and the second extension portion cooperate with the limit structures respectively to realize the front and rear limits.

2. The refrigerator according to claim 1, wherein the limit structures are ribs integrally formed with the storage liner.

3. The refrigerator according to claim 2, wherein the limit structure at the front part of the evaporator comprises: at least one first rib extending in a left-right direction; and the limit structure at the rear part of the evaporator comprises: at least two second ribs in spaced arrangement and extending in a front-rear direction.

4. The refrigerator according to claim 1, wherein the first extension portion is formed by extending downward from the front side of the cover body; and the second extension portion is formed by extending upward from the rear side of the cover body.

5. The refrigerator according to claim 1, wherein the evaporator further comprises an upper cover plate arranged above the main body part, and at least two mounting holes in spaced arrangement are formed on a front part of the upper cover plate;

the top cover is provided with at least two positioning pins in spaced arrangement on a front side thereof; and the positioning pins are arranged corresponding to the mounting holes of the upper cover plate, and the positioning pins are adapted and fixed to the mounting holes of the upper cover plate to fix the evaporator with the top cover, so as to realize the front and rear, left and right limits of the evaporator.

6. The refrigerator according to claim 4, wherein the storage liner further comprises protrusions formed between left and right side walls and the bottom wall, and front end surfaces of the two protrusions are provided with at least one mounting hole respectively;

the top cover comprises a top cover body and an extension portion extending downward from a front side of the top cover body, and the extension portion is provided with at least one mounting hole respectively on left and right sides thereof; and the mounting holes of the extension portion are arranged corresponding to the mounting holes of the protrusions, and the top cover is fixed with the protrusions by fixing members, thereby further enhancing the fixation of the evaporator in the cooling space.

7. The refrigerator according to claim 6, further comprising:

an air supply duct, arranged on the inner side of a rear wall of the storage liner, communicated with the cooling space, and configured to deliver at least part of the cooling airflow into the storage space;

the top cover further comprises a supporting portion protruding upward from a rear end of the top cover body; and a front wall surface of the air supply duct is provided with a bearing portion protruding forward, and the top cover and the air supply duct are arranged such that the supporting portion supports the bearing portion to prevent the air supply duct from falling.

8. The refrigerator according to claim 1, further comprising:

at least one return air hood, arranged at a front end of the top cover, and confining the cooling space together with the top cover and the bottom wall of the storage liner; and the return air hood comprises:

a return air frame on the front side, a front wall surface of which is provided with a first opening, and a rear end of which is open; and a return air rear cover, inserted into the return air frame from an open position at the rear end of the return air frame, and arranged to divide the first opening into a first front return air inlet at the upper part and a second front return air inlet at the lower part, to facilitate the back flow of return air in the storage space to the cooling space through the first front return air inlet and the second front return air inlet.

9. The refrigerator according to claim 8, wherein the return air frame comprises a first flow guide inclined section extending backward and upward from an upper end of the front wall surface of the return air frame, and a second flow guide inclined section extending backward and downward from a position near a lower end of the front wall surface of the return air frame;

the return air rear cover comprises a third flow guide inclined section extending forward and downward from back to front, a fourth flow guide inclined section extending forward and downward from a lower end of the third flow guide inclined section, a fifth flow guide inclined section extending backward and downward from a front end of the fourth flow guide inclined section, and a sixth flow guide inclined section extending backward and downward from a lower end of the fifth flow guide inclined section;

the first flow guide inclined section, the third flow guide inclined section, and the fourth flow guide inclined section confine a first return air duct behind the first front return air inlet, and the third flow guide inclined section is provided with second openings; and the second flow guide inclined section and the sixth flow guide inclined section confine a second return air duct behind the second front return air inlet.

10. A refrigerator, comprising:

a refrigerator body, comprising a storage liner at a bottommost position;

a top cover, arranged to divide the storage liner into a storage space at the upper part and a cooling space at the lower part;

an evaporator, arranged in the cooling space and configured to cool an airflow entering the cooling space to form a cooling airflow, wherein the evaporator is placed on a bottom wall of the storage liner, and the bottom wall is provided with a limit structure at the front part and rear part of the evaporator respectively, to realize front and rear limits of the evaporator; and at least one return air hood, arranged at a front end of the top cover, and confining the cooling space together with the top cover and the bottom wall of the storage liner, wherein the return air hood comprises:

a return air frame on the front side, a front wall surface of which is provided with a first opening, and a rear end of which is open; and a return air rear cover, inserted into the return air frame from an open position at the rear end of the return air frame, and arranged to divide the first opening into a first front return air inlet at the upper part and a second front return air inlet at the lower part, to facilitate the back flow of return air in the storage space to the cooling space through the first front return air inlet and the second front return air inlet.

11. The refrigerator according to claim 10, wherein the return air frame comprises a first flow guide inclined section extending backward and upward from an upper end of the front wall surface of the return air frame, and a second flow guide inclined section extending backward and downward from a position near a lower end of the front wall surface of the return air frame;

the return air rear cover comprises a third flow guide inclined section extending forward and downward from back to front, a fourth flow guide inclined section extending forward and downward from a lower end of the third flow guide inclined section, a fifth flow guide inclined section extending backward and downward from a front end of the fourth flow guide inclined section, and a sixth flow guide inclined section extending backward and downward from a lower end of the fifth flow guide inclined section;

the first flow guide inclined section, the third flow guide inclined section, and the fourth flow guide inclined section confine a first return air duct behind the first front return air inlet, and the third flow guide inclined section is provided with second openings; and the second flow guide inclined section and the sixth flow guide inclined section confine a second return air duct behind the second front return air inlet.

* * * * *